US010954042B2

(12) United States Patent
French et al.

(10) Patent No.: US 10,954,042 B2
(45) Date of Patent: Mar. 23, 2021

(54) PACKAGE

(71) Applicant: Berry Global, Inc., Evansville, IN (US)

(72) Inventors: Jordan Robert French, Evansville, IN (US); Seth Tempel, Evansville, IN (US)

(73) Assignee: Berry Global, Inc., Evansville, IN (US)

( * ) Notice: Subject to any disclaimer, the term of this patent is extended or adjusted under 35 U.S.C. 154(b) by 0 days.

(21) Appl. No.: 16/295,202

(22) Filed: Mar. 7, 2019

(65) Prior Publication Data

US 2019/0276201 A1 Sep. 12, 2019

Related U.S. Application Data

(60) Provisional application No. 62/639,647, filed on Mar. 7, 2018.

(51) Int. Cl.

| | |
|---|---|
| ***B65D 43/22*** | (2006.01) |
| ***B65D 50/00*** | (2006.01) |
| ***B65D 25/08*** | (2006.01) |
| ***B65D 43/16*** | (2006.01) |
| ***B65D 50/04*** | (2006.01) |
| ***B65D 41/04*** | (2006.01) |

(52) U.S. Cl.

CPC ..... *B65D 43/22* (2013.01); *B65D 25/08* (2013.01); *B65D 41/0485* (2013.01); *B65D 43/162* (2013.01); *B65D 50/00* (2013.01); *B65D 50/043* (2013.01); *B65D 50/046* (2013.01); *B65D 2543/00805* (2013.01); *B65D 2543/00814* (2013.01)

(58) Field of Classification Search

CPC .. B65D 43/22; B65D 41/0485; B65D 50/046; B65D 50/043; B65D 50/00; B65D 25/08; B65D 43/162; B65D 2543/00814; B65D 2543/00805

USPC ..... 220/212.5, 293, 326, 784, 786, 788; 215/216, 305, 320, 321

See application file for complete search history.

(56) References Cited

U.S. PATENT DOCUMENTS 3,703,975 A * 11/1972 Wittemer ..... B65D 50/067 215/213
4,480,762 A * 11/1984 Thomas ..... B65D 50/045 215/216
4,752,014 A * 6/1988 House ..... B65D 50/046 215/216
5,000,062 A * 3/1991 Bergmeister ..... B67B 7/066 81/3.4
5,230,433 A 7/1993 Hamilton et al.
5,449,077 A * 9/1995 Seidler ..... B65D 50/045 215/206
5,449,078 A 9/1995 Akers
5,603,421 A * 2/1997 Opresco ..... B65D 50/046 215/217
5,908,125 A * 6/1999 Opresco ..... B65D 50/046 215/216

(Continued)

OTHER PUBLICATIONS

Leafs by Snoop—Pentagram. [online]. Pentagram, 1972 [retrieved on May 16, 2019]. Retrieved from the Internet: <URL: www.pentagram.com/work/leafs-by-snoop-1.html>.

(Continued)

*Primary Examiner* — James N Smalley

(57) ABSTRACT

A package having a container and a selectively openable lid to selectively allow access to the container is disclosed.

8 Claims, 11 Drawing Sheets

(56) References Cited

U.S. PATENT DOCUMENTS

| | | | | |
|---|---|---|---|---|
| 5,927,528 | A | 7/1999 | Jones | |
| 6,076,689 | A | 6/2000 | Vassallo | |
| 6,439,409 | B1 * | 8/2002 | Dressel | B65D 50/046 215/209 |
| 6,679,381 | B1 | 1/2004 | Bush | |
| 7,549,541 | B2 | 6/2009 | Brozell et al. | |
| 8,066,122 | B2 | 11/2011 | Beecroft et al. | |
| 8,220,636 | B2 | 7/2012 | Beecroft et al. | |
| 8,292,110 | B2 | 10/2012 | Rutter et al. | |
| 8,839,803 | B2 | 9/2014 | Holloway | |
| 9,694,955 | B2 | 7/2017 | Wu et al. | |
| 9,878,821 | B2 | 1/2018 | Sibley | |
| 9,895,698 | B2 | 2/2018 | Spielman | |
| 10,856,681 | B2 * | 12/2020 | Abdiye | B65D 47/20 |
| 2008/0283527 | A1 * | 11/2008 | Allen | B65D 43/0212 220/253 |
| 2008/0296301 | A1 * | 12/2008 | Baughman | B65D 47/063 220/289 |
| 2010/0025355 | A1 * | 2/2010 | Beecroft | B65D 50/046 215/216 |
| 2011/0000814 | A1 | 1/2011 | Lee et al. | |
| 2016/0039591 | A1 | 2/2016 | Kinzer | |
| 2016/0090213 | A1 | 3/2016 | Murray | |
| 2016/0206829 | A1 * | 7/2016 | Protasiewicz | A61M 5/3204 |
| 2017/0007004 | A1 | 1/2017 | Burditt et al. | |
| 2017/0027168 | A1 | 2/2017 | Heath | |
| 2017/0112181 | A1 | 4/2017 | Belfance et al. | |
| 2017/0113841 | A1 | 4/2017 | Murray | |
| 2017/0319009 | A1 | 11/2017 | Seckel et al. | |
| 2017/0349338 | A1 | 12/2017 | Ziering et al. | |
| 2018/0042890 | A1 | 2/2018 | Sinai et al. | |

OTHER PUBLICATIONS

Leafs by Snoop. [online]. [retrieved on May 16, 2019]. Retrieved from the Internet: <URL: www.leafsbysnoop.com/home/html>.

Non Final Office Action of U.S. Appl. No. 16/295,182 dated Aug. 25, 2020, all enclosed pages cited.

Non Final Office Action of U.S. Appl. No. 16/295,197 dated Jun. 15, 2020, all enclosed pages cited.

Non Final Office Action of U.S. Appl. No. 16/295,200 dated Dec. 4, 2020, all enclosed pages cited.

* cited by examiner

PACKAGE

PRIORITY CLAIM

This application claims priority under 35 U.S.C. § 119(e) to U.S. Provisional Application Ser. No. 62/639,647, filed Mar. 7, 2018, which is expressly incorporated by reference herein.

TECHNICAL FIELD

The present disclosure relates generally to a container, and more specifically to a container for storing perishables that has features for resisting undesired opening.

BACKGROUND

It is often desirable to provide a container for storing items, which may include perishable items, that also has features that make opening it child resistant.

SUMMARY

Certain embodiments according to the present disclosure provide a package with one or more selectively openable and/or closable lid portions.

In one aspect, for instance, a package is provided including a container having a floor and a side wall that cooperate to form a product storage region. The package also includes a lid that is movable between a closed position in which the lid is at least partially blocking access to the product storage region, and an open position in which the lid is at least partially moved away from the closed position such that the product storage region is accessible by a user. The lid includes at least one pair of opposed radially inwardly projecting beads configured to abut a corresponding attachment mechanism of the container when the at least one pair of opposed radially inwardly projecting beads are in a relaxed state and when the lid is coupled to the container in the closed position. The corresponding attachment mechanism of the container includes a radially outwardly projecting bead configured to form a mechanical stop with at least one of the radially inwardly projecting beads of the lid to prevent axial movement of the lid relative to the container and provide a locking mechanism when the lid is couple to the container in a closed position and the lid is in the relaxed state. The at least one pair of opposed radially inwardly projecting beads of the lid are coupled to at least one pair of opposed upwardly extending pull tabs that are coupled to a lid top wall and extend upwardly past the lid top wall. The upwardly extending pull tabs are selectively inwardly movable in a radial direction from the relaxed state to the compressed state by a user input rotating inwardly about the lid top wall causing radially outward movement of the at least one pair of opposed radially inwardly projecting beads from the relaxed state and a locked position to a compressed state and a released position.

In another aspect, a package is provided having a container having a floor and a side wall that cooperate to form a product storage region. The package also includes a lid that is movable between a closed position in which the lid is at least partially blocking access to the product storage region, and an open position in which the lid is at least partially moved away from the closed position such that the product storage region is accessible by a user. The lid includes at least one pair of opposed radially inwardly projecting beads configured to abut a corresponding attachment mechanism of the container when the at least one pair of opposed radially inwardly projecting beads are in a relaxed state and when the lid is coupled to the container in the closed position. The corresponding attachment mechanism of the container includes a radially outwardly projecting bead configured to form a mechanical stop with at least one of the radially inwardly projecting beads of the lid to prevent axial movement of the lid relative to the container and provide a locking mechanism when the lid is couple to the container in a closed position and the lid is in the relaxed state. The at least one pair of opposed radially inwardly projecting beads of the lid are coupled to at least one pair of opposed upwardly extending pull tabs that are coupled to a lid top wall and extend upwardly past the lid top wall. The upwardly extending pull tabs are selectively inwardly movable in a radial direction from the relaxed state to the compressed state by a user input rotating inwardly about the lid top wall causing radially outward movement of the at least one pair of opposed radially inwardly projecting beads from the relaxed state and a locked position to a compressed state and a released position. The upwardly extending pull tabs extend radially outwardly beyond an outer diameter of the container side wall.

BRIEF DESCRIPTION OF THE DRAWINGS

Embodiments now will be described more fully hereinafter with reference to the accompanying drawings, in which some, but not all embodiments may be shown. Indeed, embodiments may be illustrated or described in many different forms and the present disclosure should not be construed as limited to the embodiments set forth herein. Like numbers refer to like elements throughout, and wherein.

DETAILED DESCRIPTION

Embodiments now will be described more fully hereinafter with reference to the accompanying drawings, in which some, but not all embodiments may be shown. Indeed, embodiments may take many different forms and the present disclosure should not be construed as limited to the embodiments set forth herein. As used in the specification, and in the appended claims, the singular forms "a", "an", "the", include plural referents unless the context clearly dictates otherwise.

The terms "substantial" or "substantially" may encompass the whole as specified, according to certain embodiments, or largely but not the whole specified according to other embodiments.

Figure 1:
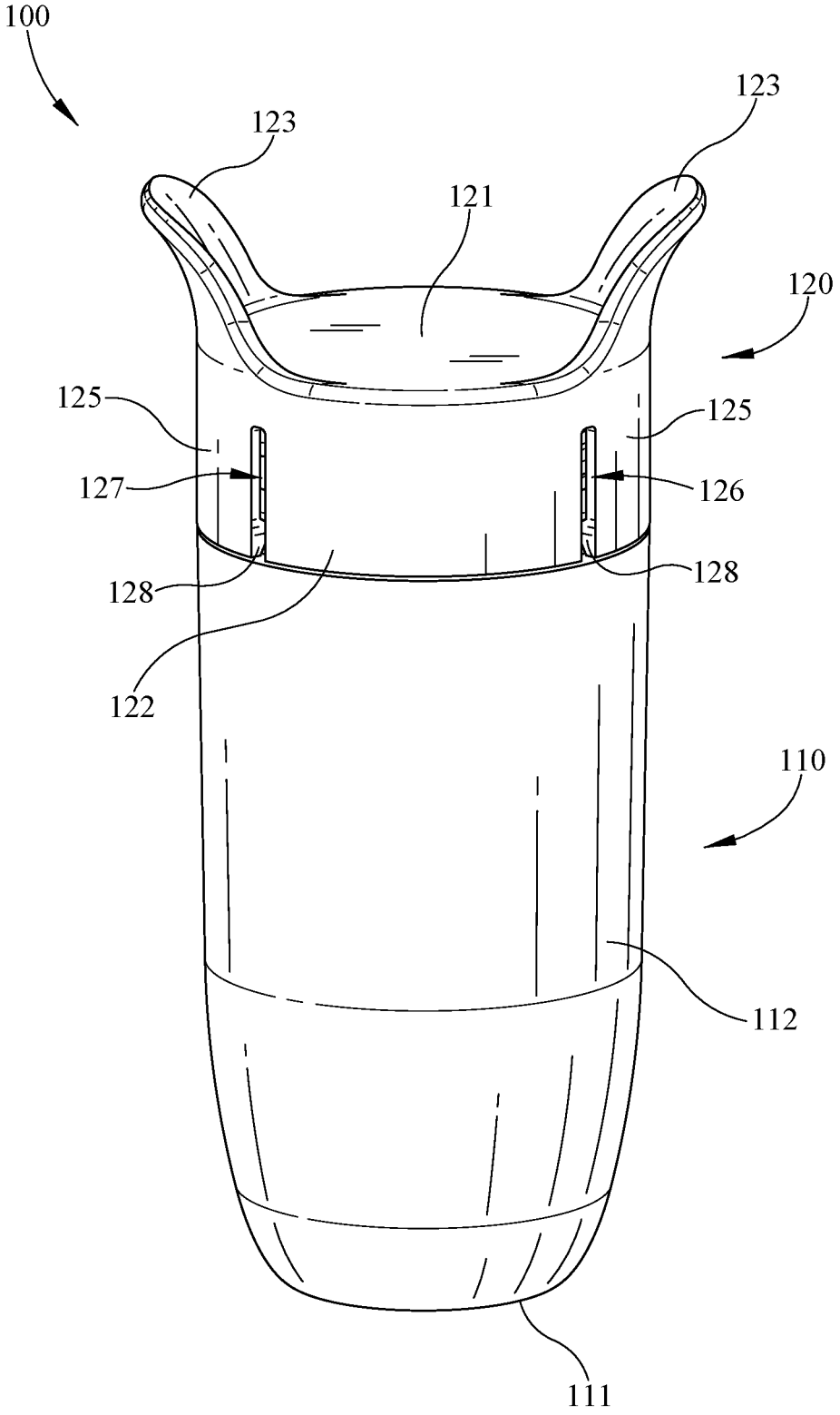
FIG. 1 illustrates a perspective view of a package.
Figure 2:
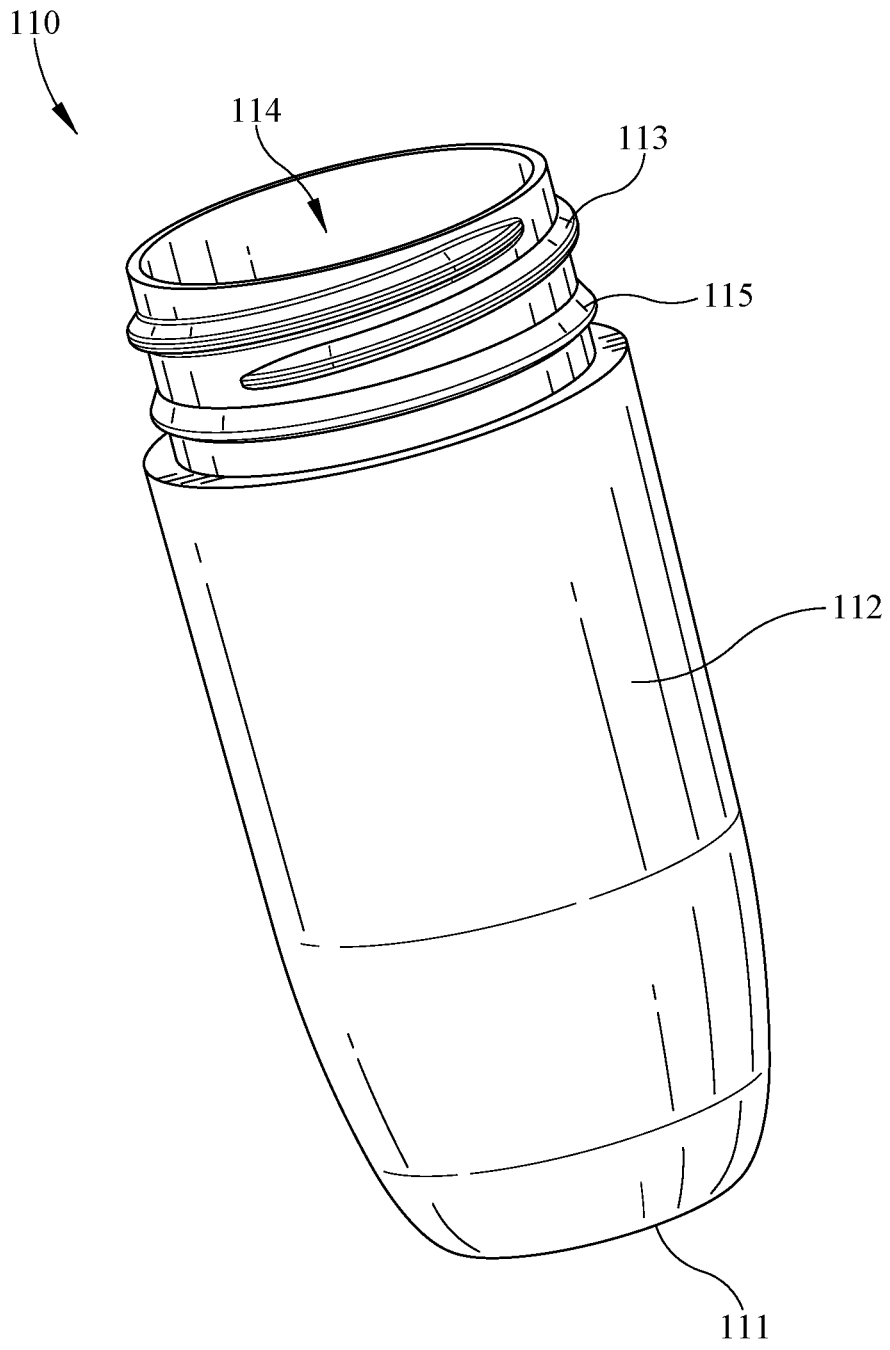
FIG. 2 illustrates a perspective view of a container according to the package of FIG. 1.

Some embodiments of a package 100 may include a container 110 and/or a lid 120, as shown, for example, in FIGS. 1 and 2. Container 110 may include an interior storage region 114 at least partially defined by floor 111 and side wall 112. Lid 120 may include a top 121 and/or a side wall 122, and/or be selectively removably attached to container 110. For example, lid 120 may be rotationally removable from and/or attachable to container 110. For example, clockwise rotation of lid 120 relative to container 110 may attach, couple, fasten, and/or tighten lid 120 on container 110, and counter-clockwise rotation may loosen and/or remove lid 120 from container 110, or vice versa.

A latching, locking, and/or blocking mechanism may be provided that prevents or inhibits rotational motion of lid 120 that would loosen or remove it from container 110. A user may selectively overcome this latching, locking, and/or blocking mechanism, for example, by actuating one or more areas or tabs 123. It is understood that tightening or attachment of lid 120 to container 110 could be provided by either clockwise or counter-clockwise rotation, with the opposite rotation resulting in loosening or removal of lid 120 from container 110, in embodiments using a threaded engagement such as is shown in FIGS. 2, 3, 4*a*, and 4*b*.

Figure 3:
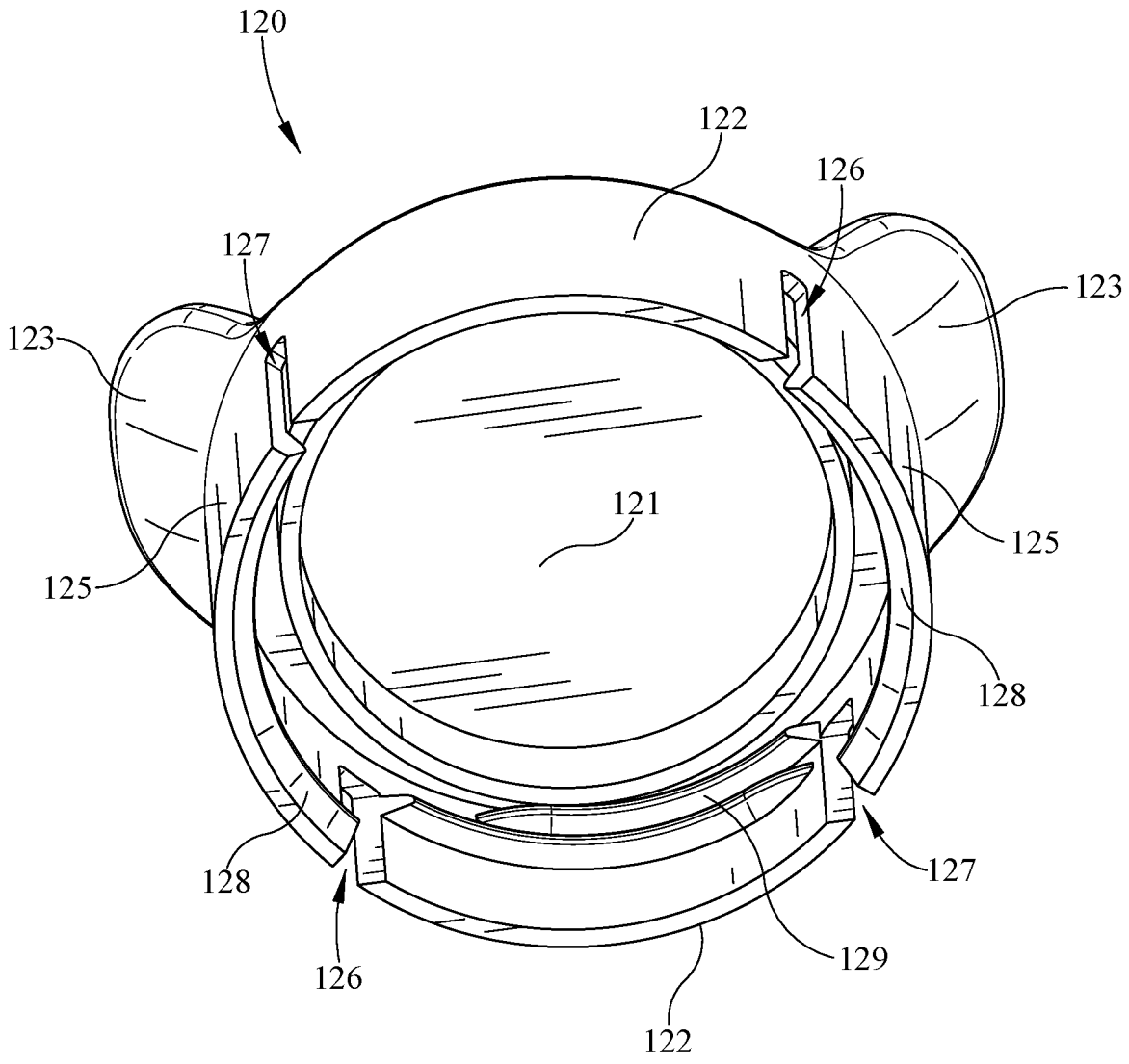
FIG. 3 illustrates a perspective view of a lid according to the package of FIG. 1.

Container 110 may include one or more features for attachment to lid 120, such as a snap bead 115, for example as shown in FIG. 2. If included, snap bead 115 may interact, engage, and/or block a corresponding structure of lid 120. Lid 120 may include one or more snap beads 128, such as shown in FIG. 3 for example, which may be the corresponding structure that interacts with container snap bead 115. When package 100, container 110, and/or lid 120 is in a resting state in a closed position, as shown for example in FIG. 4*a*, container snap bead 115 and lid snap beads 128 may align so as to form a mechanical stop and/or prevent vertical translation of lid 120 relative to container 110. A user may overcome this blocking mechanism by pressing one or more tabs 123 inwardly causing lid snap beads 128 to deflect outwardly enough to move them out of blocking alignment with container snap bead 115 as shown in FIG. 4*b*. Removing this blocking alignment may allow rotation of lid 120 relative to container 110 and corresponding vertical translation due to the threaded engagement of lid 120 with container 110.

A thread 129 on lid 120 is shown in FIG. 3. Thread 129 may be on an internal surface of a non-deflecting area of side wall 122. Non-deflecting area of side wall 122 may be separated from a deflecting area 125 (e.g., an area deflected by actuation of tab 123) by one or more spaces or gaps 126, 127. A user may actuate areas or tabs 123 to remove the blocking mechanism, then may rotate lid 120 to loosen and/or remove it and gain access to the interior region of container 110.

Figure 4A:
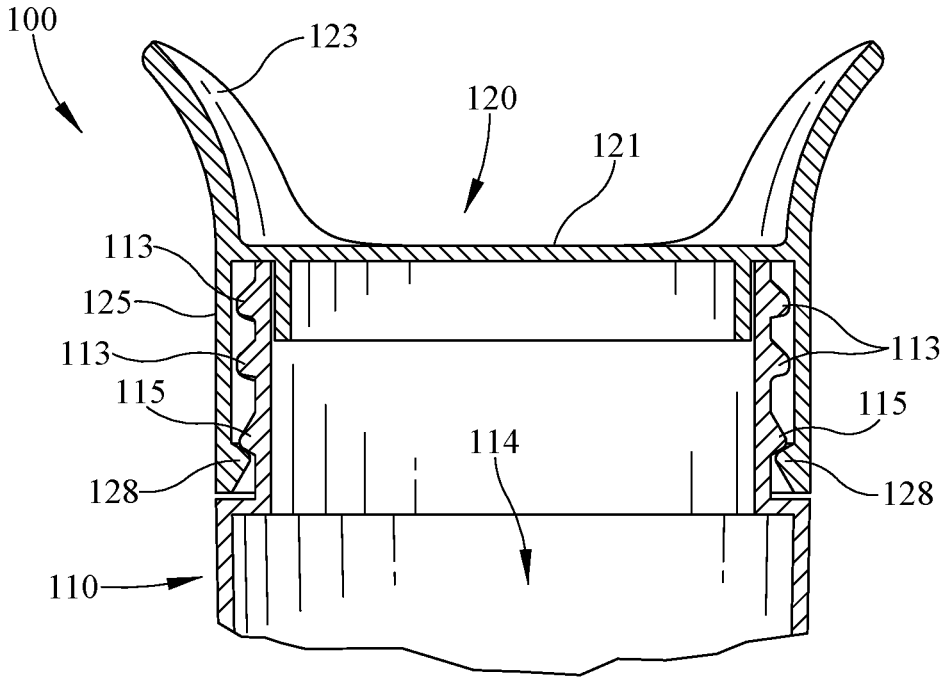
FIG. 4*a* illustrates a front cross-section view of a top portion of the container of FIG. 1 with the lid in a resting state and a locked position.
Figure 4B:
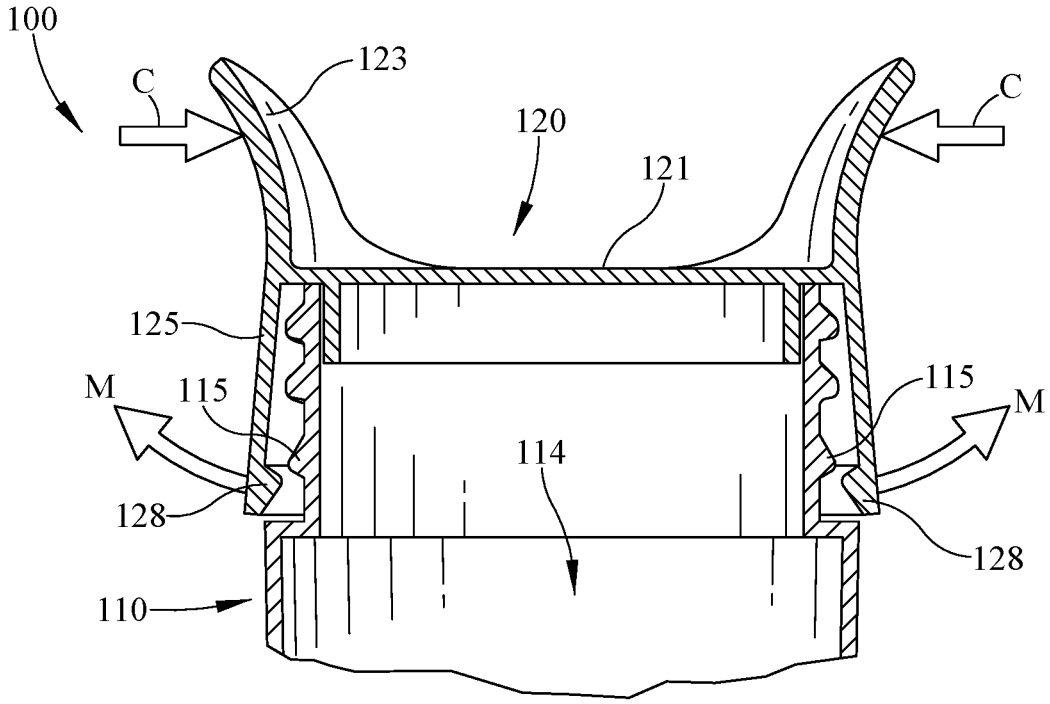
FIG. 4*b* illustrates a front cross-section view of a top portion of the container of FIG. 1 with the lid in a compressed state and a released position.

Lid 120 and package 100 are shown in a relaxed state, a closed position, and a locked position in FIG. 4*a*. In the relaxed state, package 100 and/or lid 120 may be substantially subjected to no substantial external forces other than those typical of the environment a package like this is generally found in. In the closed position, lid 120 is coupled to container 110 to substantially block a user from accessing product storage region 114. In the locked position, the pair of radially inwardly projecting beads 128 of lid 120 are adjacent to and/or engaging the externally projecting container bead 115. In the locked position, container bead 115 and lid bead 128 may form a mechanical stop that inhibits or prevents axial movement of lid 120 relative to container 110 to substantially inhibit or prevent removal of lid 120 from container 110 and/or movement of lid 120 from the closed position to an open position in which a user may readily access product storage region 114.

A user may selectively engage the pair of oppositely disposed upwardly extending lid tabs 123 to move lid 120, transitioning lid 120 from the relaxed state to a compressed state, and/or transitioning lid 120 from the locked position to a released position, as shown, for example, in FIG. 4*b*. Radially inward deflection, compression, or movement of tabs 123 toward the center or axis of lid 120, for example as indicated by compression movement C, may cause lid side wall 120 to hinge about lid top wall 121 and the deflecting areas 125 of lid therebelow to flex or deflect outwardly as indicated by outward movement M. A user input such as compression C may cause outward deflection of deflecting areas 125 that are coupled to inwardly projecting lid beads 128 away from container bead 115 to provide a released position in which container beads 115 do not block axial motion of lid 120 relative to container 110.

Figure 5:
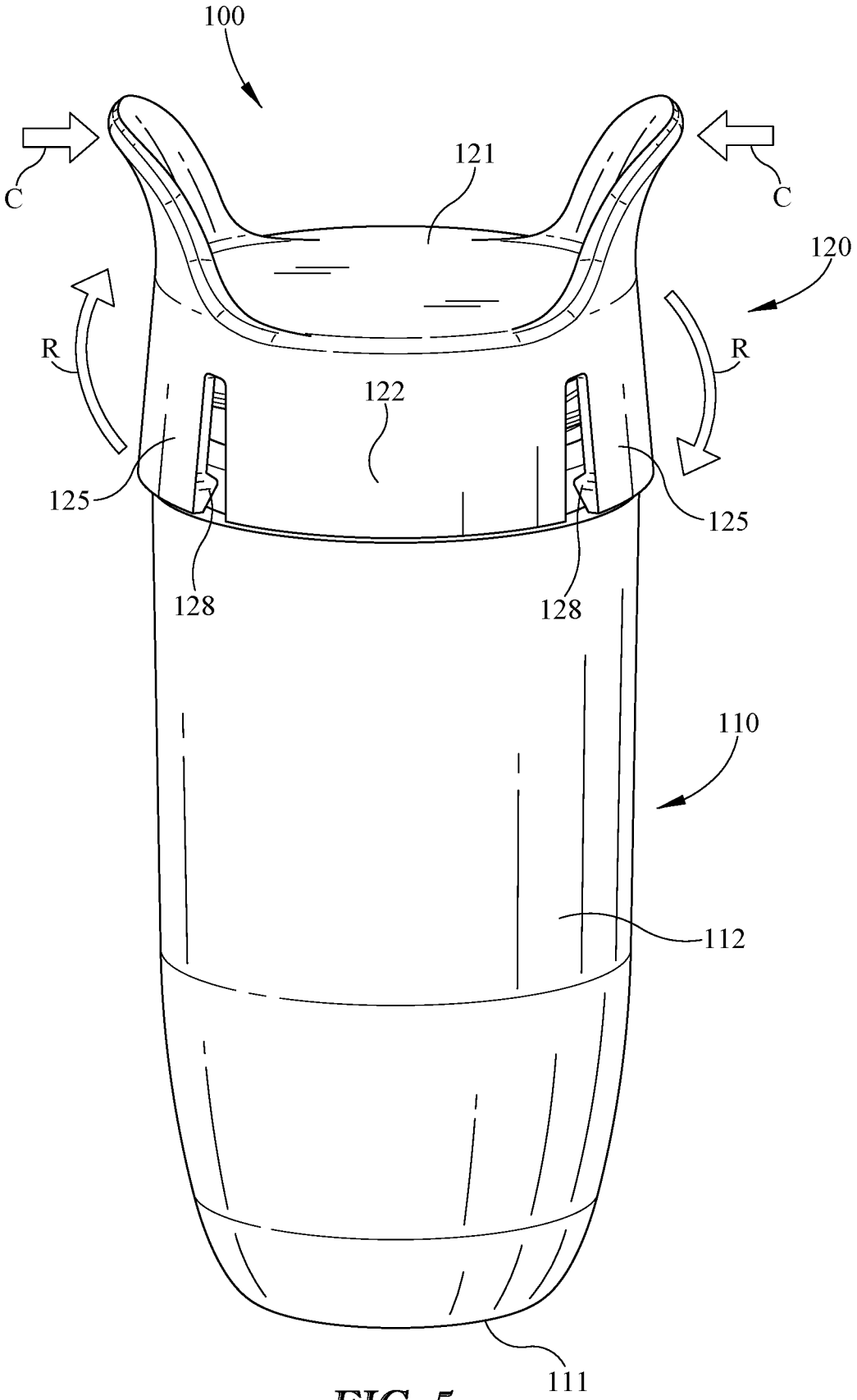
FIG. 5 illustrates a perspective view of the package of FIG. 1 in a compressed state and a released position.
Figure 6:
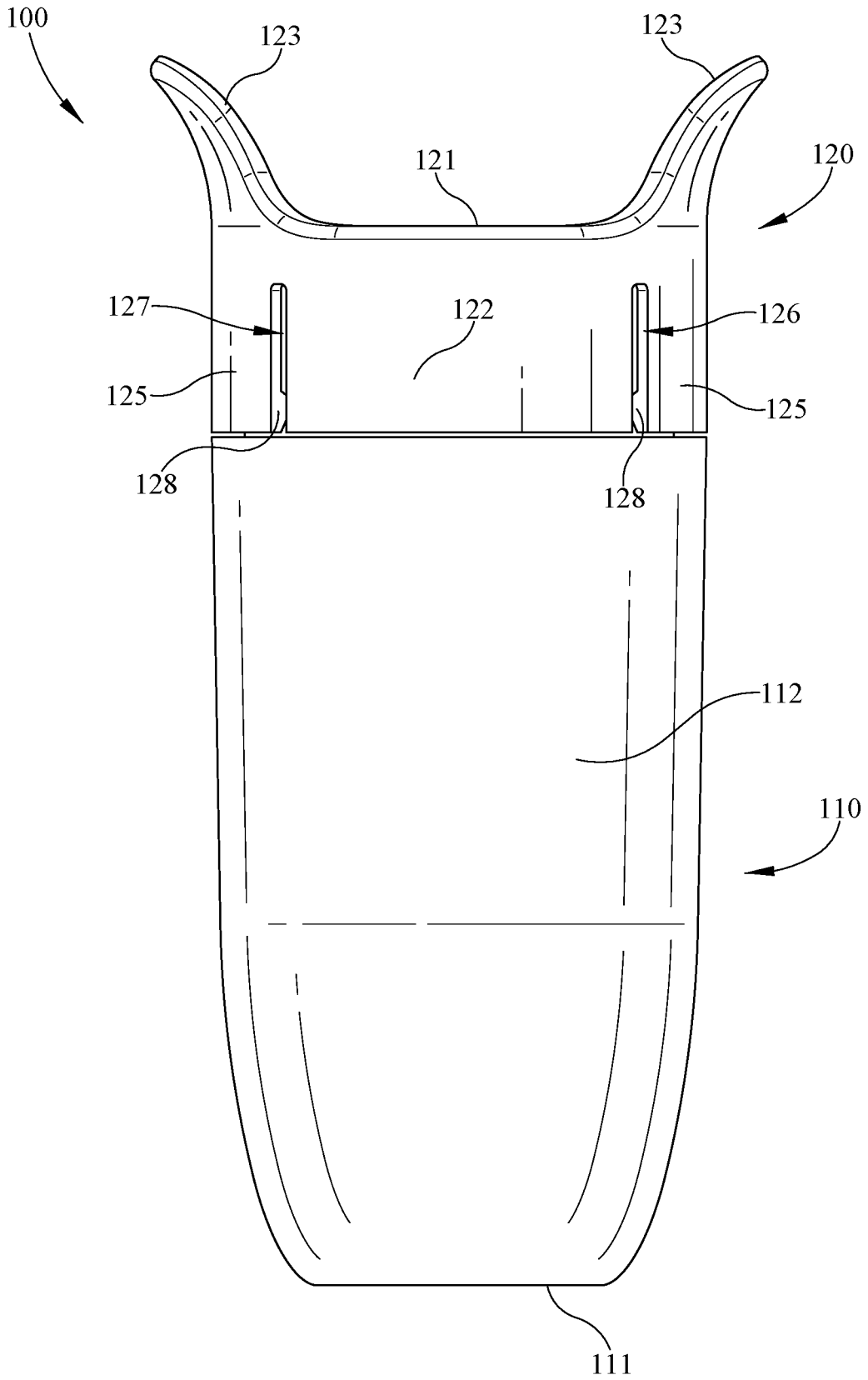
FIG. 6 illustrates a front view of the package of FIG. 1.
Figure 7:
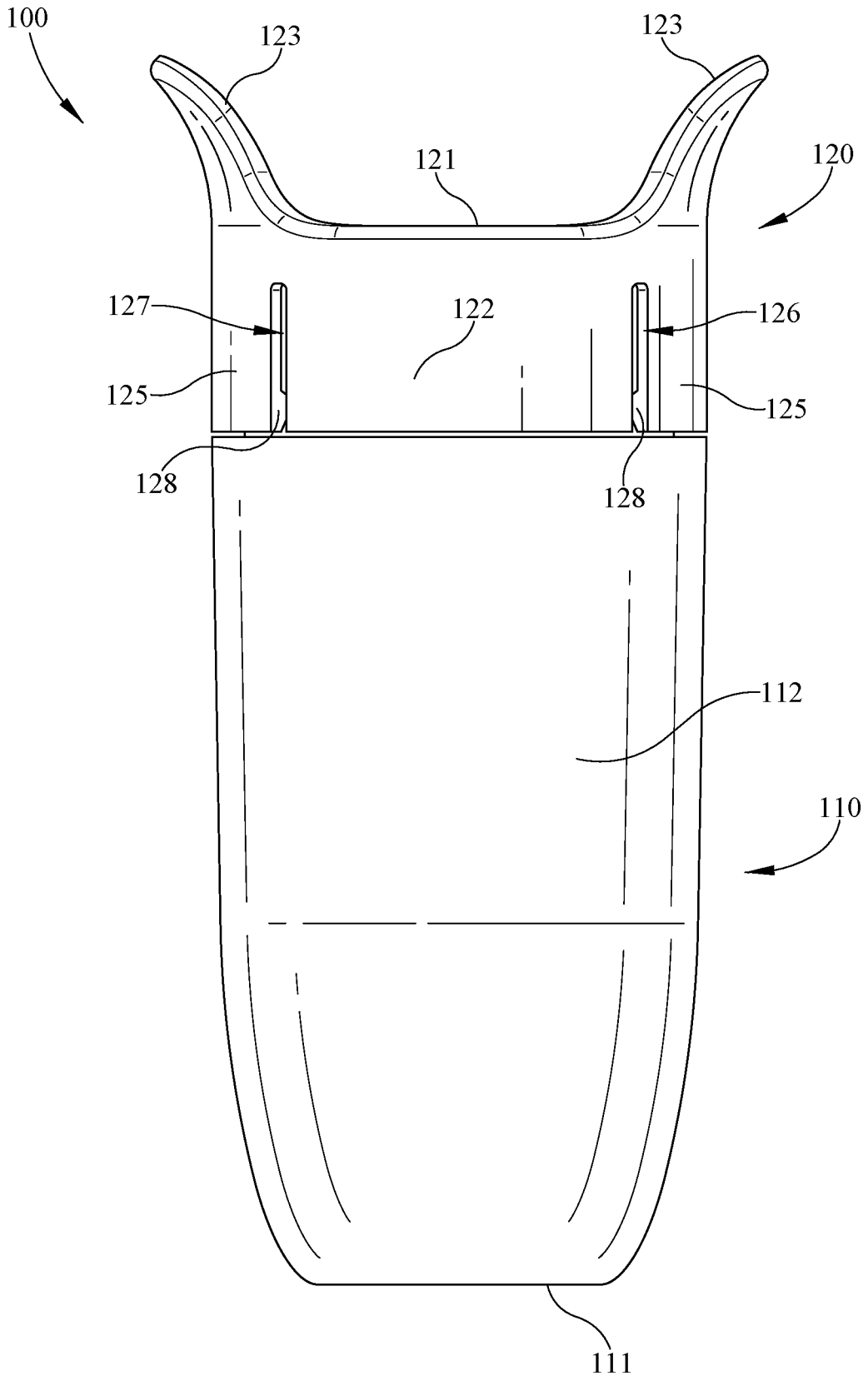
FIG. 7 illustrates a back view of the package of FIG. 1.
Figure 8:
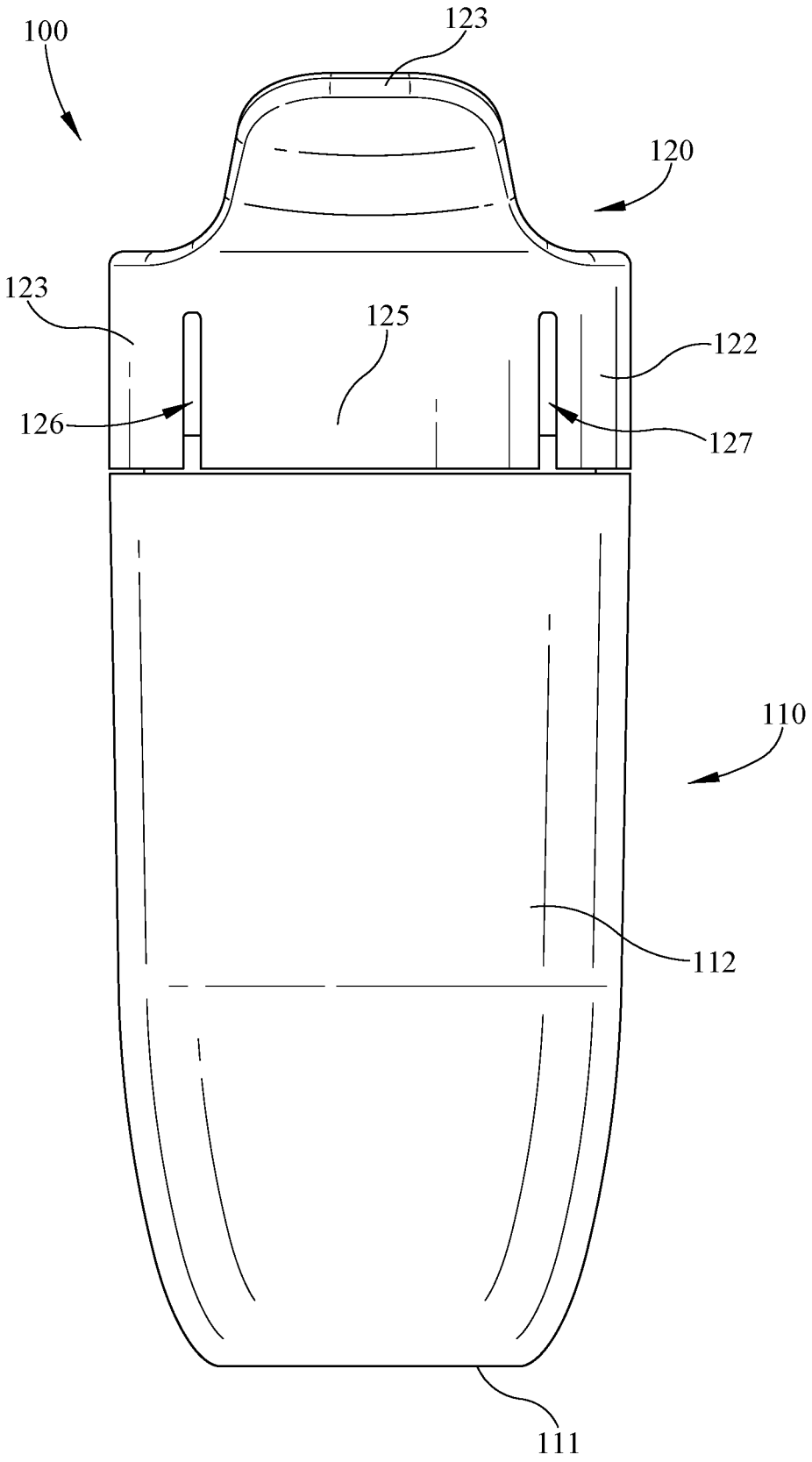
FIG. 8 illustrates a first side view of the package of FIG. 1.
Figure 9:
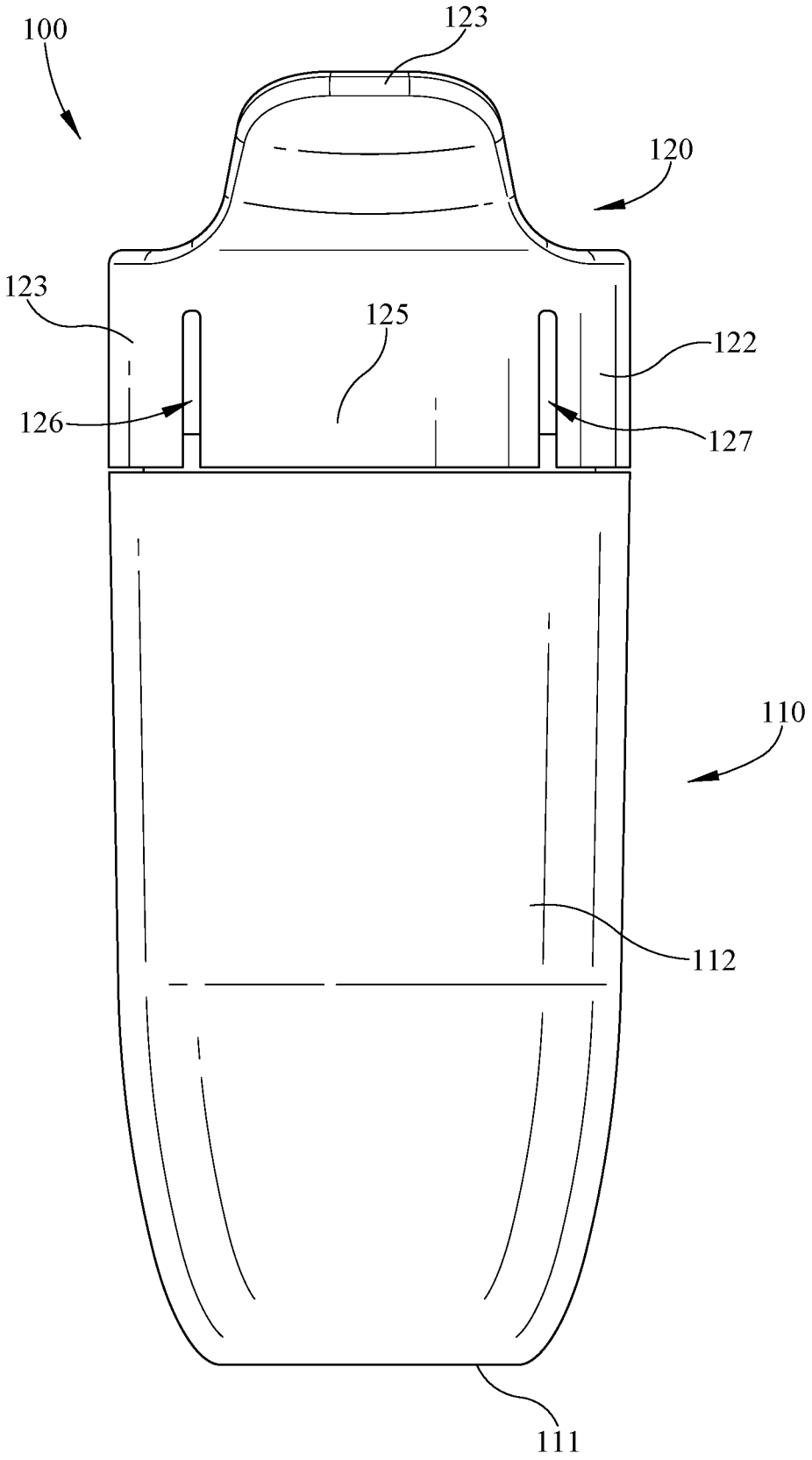
FIG. 9 illustrates a second side view of the package of FIG. 1, which is opposite the view of FIG. 10.
Figure 10:
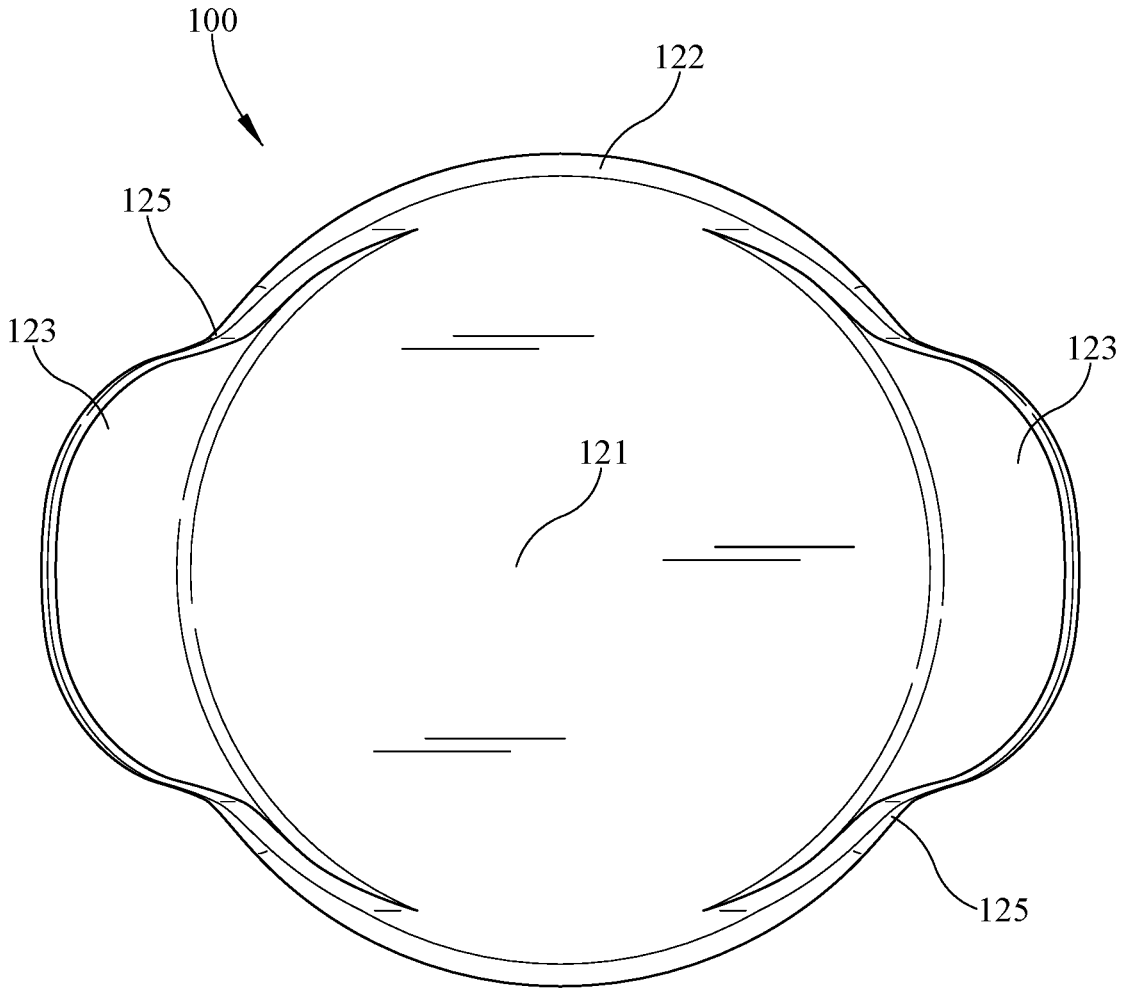
FIG. 10 illustrates a top view of the package of FIG. 1.
Figure 11:
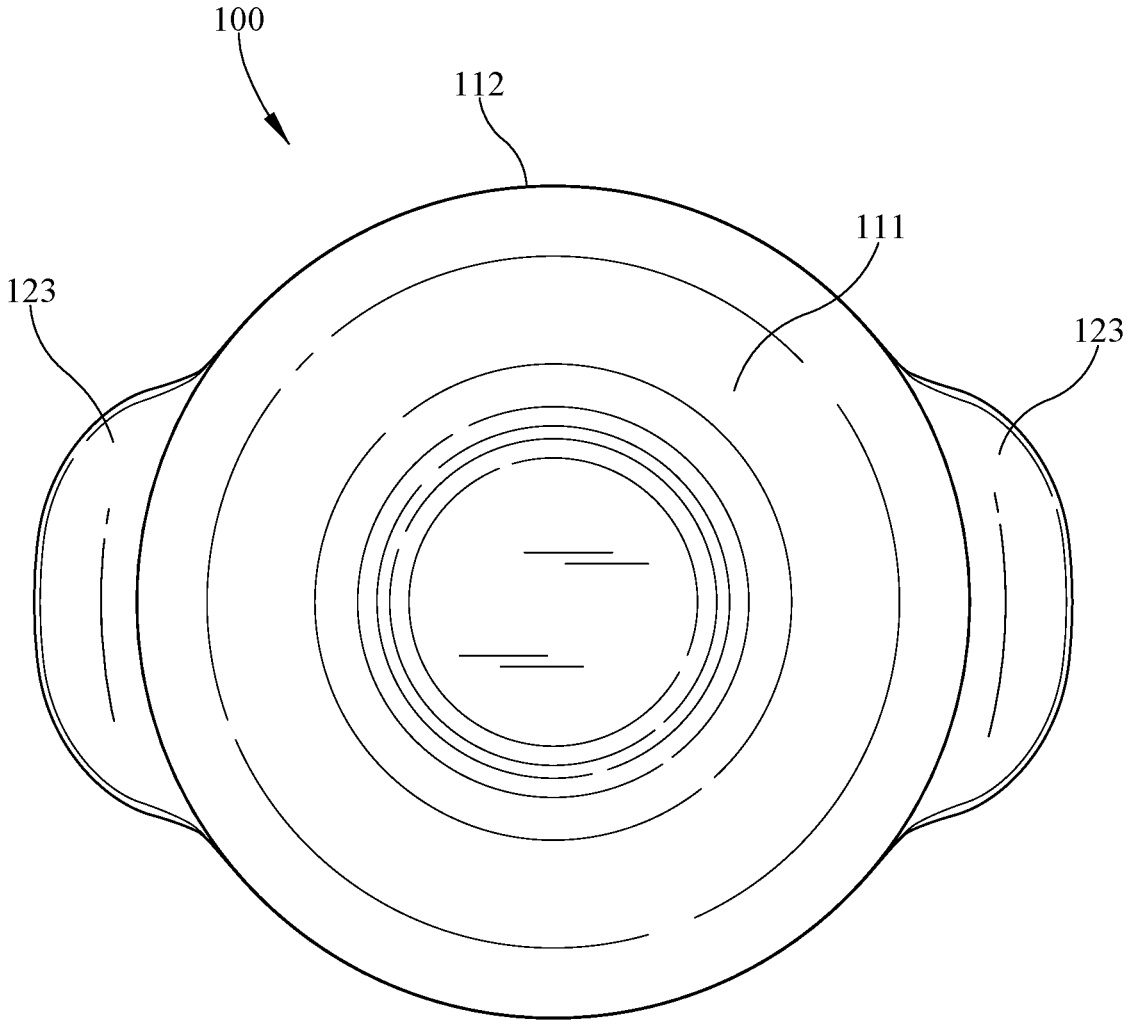
FIG. 11 illustrates a bottom view of the package of FIG. 1.

FIG. 5 illustrates package 100 and/or lid 120 in a compressed state and/or a released position as previously described. In this released position, a user may selectively rotate lid 120 about a central axis, for example, in rotation direction R or in the opposite direction, to cause axial movement of lid 120 relative to container 110 via the aforementioned threaded engagement. In some embodiments, either or both of container bead 115 and lid bead 128 may include an upper surface and a lower surface that is more or less angled to facilitate one-direction axial movement of one past the other. For example, as shown in FIG. 4*a*, container bead 128 may have a relatively gradual angled surface on the bottom so that it may pass downwardly over container bead 115 to allow lid 120 to be threaded into the locked position even without a user compressing tabs 123. Continuing this example, container bead 128 may have a relatively steep angled surface on top to prevent or inhibit axial movement upwardly so that lid 120 is prevented or made difficult to remove from container 110 without the addition user input compressing tabs 123.

Package 100 and various components thereof are shown in additional detail in FIGS. 6-11. Package 100, container 110, and/or lid 120 may be substantially symmetrical as shown. Such symmetrical configuration, if included, may facilitate attachment of lid 120 to container 110 in more than one specific orientation. While package 100 is shown in a generally cylindrical configuration, it is understood that package 100, container 110, and/or lid 120 may be of any of a variety of shapes virtually without limitation.

It is understood that package 100 container 110, lid 120, and/or any component thereof, may be made of any of a variety of materials, including, but not limited to, any of a variety of suitable plastics material, any other material, or any combination thereof. Suitable plastics material may include, but is not limited to, polypropylene (PP), polyethylene (PE), polyethylene terephthalate (PET), polystyrene (PS), high-density polyethylene (HDPE), low-density polyethylene (LDPE), linear low-density polyethylene (LLDPE), crystallized polyethylene terephthalate (CPET), mixtures and combinations thereof, or any other plastics material or any mixtures and combinations thereof. It is understood that multiple layers of material may be used for any of a variety of reasons, including to improve barrier properties, or to provide known functions related to multiple layer structures. The multiple layers, if included, may be of various materials, including but not limited to those recited herein.

It is further understood that package 100 container 110, lid 120, may be substantially rigid, substantially flexible, a hybrid of rigid and flexible, or any combination of rigid, flexible, and/or hybrid, such as having some areas be flexible and some rigid. It is understood that these examples are merely illustrative, are not limiting, and are provided to illustrate the versatility of options available in various embodiments of package 100 container 110, lid 120, and/or any component thereof.

It is further understood that any of a variety of processes or combination thereof may be used to form package 100 container 110, lid 120, and/or any component thereof, or any layer or substrate used therein. For example, any component, layer, or substrate, or combination thereof, may be thermoformed, injection molded, injection stretch blow molded, blow molded, extrusion blow molded, coextruded, subjected to any other suitable process, or subjected to any combination thereof. In some embodiments, package 100 container 110, lid 120, and/or any component thereof may be formed substantially of injection molded and/or thermoformed suitable plastics material, although other materials and forming processes may be used instead of or in addition to injection molding and thermoforming, respectively. Various materials and/or processes may be used to form package 100 container 110, lid 120, and/or any component thereof, as will be understood by one of ordinary skill in the art. In some embodiments, container 110, lid 120, and/or any component thereof, may be substantially a one-piece design and/or substantially formed as an integral or unitary structure.

It is understood that, while some directional terms are used herein, such as top, bottom, upper, lower, inward, outward, upward, downward, etc., these terms are not intended to be limiting but rather to relate to one or more exemplary orientations, positions, and/or configurations of package 100 container 110, lid 120, and/or any component thereof. It is understood that package 100 container 110, lid 120, may be oriented differently than shown in the various figures.

These and other modifications and variations may be practiced by those of ordinary skill in the art without departing from the spirit and scope, which is more particularly set forth in the appended claims. In addition, it should be understood that aspects of the various embodiments may be interchanged in whole or in part. Furthermore, those of ordinary skill in the art will appreciate that the foregoing description is by way of example only, and it is not intended to limit the scope of that which is described in the claims. Therefore, the spirit and scope of the appended claims should not be limited to the exemplary description of the versions contained herein.

That which is claimed:

1. A package, comprising:

a container having a floor and a side wall that cooperate to form a product storage region; and a lid that is movable between a closed position in which the lid is at least partially blocking access to the product storage region, and an open position in which the lid is at least partially moved away from the closed position such that the product storage region is accessible by a user;

wherein the lid includes at least one pair of opposed radially inwardly projecting beads configured to abut a corresponding attachment mechanism of the container when the at least one pair of opposed radially inwardly projecting beads are in a relaxed state and when the lid is coupled to the container in the closed position;

wherein the corresponding attachment mechanism of the container includes a radially outwardly projecting bead configured to form a mechanical stop with at least one of the radially inwardly projecting beads of the lid to prevent axial movement of the lid relative to the container and provide a locking mechanism when the lid is coupled to the container in a closed position and the lid is in the relaxed state;

wherein the at least one pair of opposed radially inwardly projecting beads of the lid are coupled to at least one pair of opposed upwardly extending pull tabs that are coupled to a lid top wall and extend upwardly past the lid top wall;

wherein the upwardly extending pull tabs are selectively inwardly movable in a radial direction from the relaxed state to the compressed state by a user input rotating inwardly about the lid top wall causing radially outward movement of the at least one pair of opposed radially inwardly projecting beads from the relaxed state and a locked position to a compressed state and a released position;

wherein axial movement of the lid relative to the container when the lid is in the compressed state and released position is provided by rotation of the lid relative to the container, and wherein the lid includes at least one internal thread configured to engage at least one external thread of the container such that rotation of the lid relative to the container engages the threads and provides the axial movement of the lid relative to the container.

2. The package of claim 1, wherein the non-deflecting areas of the lid sidewall each include a portion of the internal thread of the lid.

3. The package of claim 2, wherein the deflecting areas of the lid sidewall have a substantially flat surface that does not include a substantial portion of the internal thread of the lid.

4. The package of claim 1, wherein the at least one pair of opposed radially inwardly projecting beads of the lid are coupled to a deflecting area of a lid side wall that is separate from a non-deflecting area of the lid side wall by at least one slot.

5. A package, comprising:

a container having a floor and a side wall that cooperate to form a product storage region; and a lid that is movable between a closed position in which the lid is at least partially blocking access to the product storage region, and an open position in which the lid is at least partially moved away from the closed position such that the product storage region is accessible by a user;

wherein the lid includes at least one pair of opposed radially inwardly projecting beads configured to abut a corresponding attachment mechanism of the container when the at least one pair of opposed radially inwardly projecting beads are in a relaxed state and when the lid is coupled to the container in the closed position;

wherein the corresponding attachment mechanism of the container includes a radially outwardly projecting bead configured to form a mechanical stop with at least one of the radially inwardly projecting beads of the lid to prevent axial movement of the lid relative to the container and provide a locking mechanism when the lid is coupled to the container in a closed position and the lid is in the relaxed state;

wherein the at least one pair of opposed radially inwardly projecting beads of the lid are coupled to at least one pair of opposed upwardly extending pull tabs that are coupled to a lid top wall and extend upwardly past the lid top wall;

wherein the upwardly extending pull tabs are selectively inwardly movable in a radial direction from the relaxed state to the compressed state by a user input rotating inwardly about the lid top wall causing radially outward movement of the at least one pair of opposed radially inwardly projecting beads from the relaxed state and a locked position to a compressed state and a released position;

wherein the upwardly extending pull tabs extend radially outwardly beyond an outer diameter of the container side wall;

wherein axial movement of the lid relative to the container when the lid is in the compressed state and released position is provided by rotation of the lid relative to the container; and wherein the lid includes at least one internal thread configured to engage at least one external thread of the container such that rotation of the lid relative to the container engages the threads and provides the axial movement of the lid relative to the container.

6. The package of claim 5, wherein the non-deflecting areas of the lid sidewall each include a portion of the internal thread of the lid.

7. The package of claim 6, wherein the deflecting areas of the lid sidewall have a substantially flat surface that does not include a substantial portion of the internal thread of the lid.

8. The package of claim 5, wherein the at least one pair of opposed radially inwardly projecting beads of the lid are coupled to a deflecting area of a lid side wall that is separate from a non-deflecting area of the lid side wall by at least one slot.

* * * * *